US008814584B2

(12) United States Patent
Allton

(10) Patent No.: US 8,814,584 B2
(45) Date of Patent: Aug. 26, 2014

(54) WET-MATEABLE ELECTRICAL CONNECTOR

(75) Inventor: Richard Allton, Leicester (GB)

(73) Assignee: Alstom Hydro France, Levallois Perret (FR)

( * ) Notice: Subject to any disclaimer, the term of this patent is extended or adjusted under 35 U.S.C. 154(b) by 112 days.

(21) Appl. No.: 13/697,515

(22) PCT Filed: May 13, 2011

(86) PCT No.: PCT/EP2011/057746

§ 371 (c)(1),
(2), (4) Date: Jan. 17, 2013

(87) PCT Pub. No.: WO2011/141565

PCT Pub. Date: Nov. 17, 2011

(65) Prior Publication Data

US 2013/0157490 A1 Jun. 20, 2013

(30) Foreign Application Priority Data

May 14, 2010 (GB) ..... 1008070.3

(51) Int. Cl.
*H01R 4/60* (2006.01)
*H01R 13/523* (2006.01)
*H01R 24/00* (2011.01)

(52) U.S. Cl.
CPC ..... *H01R 24/00* (2013.01); *H01R 13/523* (2013.01)
USPC ..... 439/198

(58) Field of Classification Search
USPC ..... 439/198–201
See application file for complete search history.

(56) References Cited

U.S. PATENT DOCUMENTS

| | | | | |
|---|---|---|---|---|
| 4,815,989 | A * | 3/1989 | Kataoka et al. | 439/426 |
| 5,358,419 | A * | 10/1994 | Pejsa et al. | 439/201 |
| 5,558,532 | A * | 9/1996 | Hopper | 439/310 |
| 7,500,859 | B2 | 3/2009 | Dubranna | |

FOREIGN PATENT DOCUMENTS

| | | | |
|---|---|---|---|
| FR | 2 529 396 | A1 | 12/1983 |
| FR | 2 607 635 | A1 | 6/1988 |
| WO | WO 01/09982 | A1 | 2/2001 |
| WO | WO 2006/070078 | A1 | 7/2006 |

* cited by examiner

*Primary Examiner* — Phuong Dinh
(74) *Attorney, Agent, or Firm* — Buchanan Ingersoll & Rooney PC

(57) ABSTRACT

A wet-mateable electrical connector comprises a vertically movable female connector unit 52 locatable over a vertically fixed male connector unit 50. The female connector unit 52 defines a chamber 62 containing a gas to exclude water and the like therefrom and having a closed upper end and an open lower end for receiving an upper end of the male connector unit 50. An insulating sheath 6 is locatable within the upper end of the female connector unit 52 to move it from a first position that protects a first electrical contactor 4 provided on the upper end of the male connector unit 50 to a second position that exposes the first electrical contactor 4. The upper end of the female connector unit 52 houses a second electrical contactor 3 which is engageable with the first electrical contactor 4 upon movement of the insulating sheath 6 from the first position to the second position.

41 Claims, 16 Drawing Sheets

(a)

(b)

WET-MATEABLE ELECTRICAL CONNECTOR

CROSS-REFERENCE TO RELATED APPLICATION

This application is a National Stage entry of International Application PCT/EP2011/057746, filed May 13, 2011, which claims priority to British Patent Application No. 1008070.3, filed May 14, 2010, the disclosure of the prior applications are hereby incorporated in their entirety by reference.

FIELD OF THE INVENTION

The present invention relates to a wet-mateable electrical connector which can be connected and disconnected in a liquid. Embodiments of the present invention relate in particular to a wet-mateable electrical connector which can be connected and disconnected underwater, especially in subsea environments. Embodiments of the present invention also provide connection and disconnection methods for a wet-mateable electrical connector.

BACKGROUND TO THE INVENTION

There is often a need to connect and disconnect electrical components in subsea or other underwater environments and a wet-mateable electrical connector can be used for this purpose.

One example of a wet-mateable electrical connector is described in U.S. Pat. No. 7,500,859 B2 and, like many other wet-mateable electrical connectors, it utilises an electrically insulating liquid such as oil and a sealing arrangement between male and female connector elements. Although the wet-mateable electrical connector can be used in any orientation, the need for an electrically insulating liquid and sealing arrangement renders the construction of this and similar wet-mateable electrical connectors relatively complex. Furthermore, close tolerances are needed between the male and female connector elements and the mating operation between those connector elements can be compromised if there is fouling due to a build up of sessile animals, such as barnacles, on the mating surfaces.

An alternative approach is to retrieve electrical components from subsea or other underwater environments and to use a dry-mateable electrical connector to connect and disconnect the electrical components in a dry environment. This alternative approach is, however, often practically and economically undesirable.

There is, therefore, a need for an improved wet-mateable electrical connector which has a less complex construction than existing liquid-sealed wet-mateable electrical connectors and which provides reliable connection and disconnection, especially in harsh subsea environments.

SUMMARY OF THE INVENTION

According to a first aspect of the present invention, there is provided a wet-mateable electrical connector comprising:—

- a vertically movable female connector unit locatable over a vertically fixed male connector unit;
- the female connector unit defining a chamber containing a gas to exclude water and the like therefrom and having a closed upper end and an open lower end for receiving an upper end of the male connector unit;
- an insulating sheath locatable within the upper end of the female connector unit for movement from a first position that protects a first electrical contactor provided on the upper end of the male connector unit to a second position that exposes the first electrical contactor;
- the upper end of the female connector unit housing a second electrical contactor engageable with the first electrical contactor upon movement of the insulating sheath from the first position to the second position.

The male and female connector units can be connected and disconnected in a simple and reliable manner, whilst ensuring that the first and second electrical contactors are at all times isolated from the surrounding liquid. After the upper end of the male connector unit has been received in the gas-filled chamber of the female connector unit, the gas-filled chamber isolates the upper end of the male connector unit from the surrounding water and the like. The insulating sheath can, thus, be moved from the first position to the second position to expose the first electrical contactor, thereby permitting the first and second electrical contactors to be engaged. The construction of the wet-mateable electrical connector is relatively simple as an electrically insulating liquid and/or a sealing arrangement are not needed. The wet-mateable electrical connector is also less susceptible to fouling of the mating surfaces as the tolerances are more relaxed than those of existing wet-mateable electrical connectors.

One embodiment of a connection method for the wet-mateable electrical connector comprises:—

- locating the vertically movable female connector unit over the vertically fixed male connector unit to locate the upper end of the male connector unit inside the gas-filled chamber of the female connector unit;
- locating the insulating sheath within the upper end of the female connector unit for movement from the first position to the second position to thereby expose the first electrical contactor; and
- engaging the first and second electrical contactors.

One embodiment of a disconnection method for the wet-mateable electrical connector comprises:

- moving the insulating sheath from the second position to the first position; and
- separating the vertically movable female connector unit from the vertically fixed male connector unit to remove the upper end of the male connector unit from the gas-filled chamber of the female connector unit.

The male connector unit typically forms part of a first electrical component and the female connector unit typically forms part of a second electrical component. The wet-mateable electrical connector thus permits connection and disconnection of the first and second electrical components in water or a similar liquid. Typically the first and/or second electrical components are non-operational when the wet-mateable electrical connector is connected or disconnected. Accordingly, no current flows through the wet-mateable electrical connector between the first and second electrical components during connection or disconnection. The wet-mateable electrical connector thus normally acts as a contactor device which is not intended to be connected or disconnected under electrical load.

The male connector unit may include a substantially vertical support member which may be substantially rigid. The male connector unit may be secured in use directly or indirectly to a sea bed or river bed and may extend substantially vertically upwardly from the sea bed or river bed. The male connector unit may form part of a gravity base structure. The male connector unit could be permanently connected to a subsea electrical network. The subsea electrical network may constitute the first electrical component.

The orientation of the vertically movable female connector unit is normally maintained during its vertical movement through the water or other liquid so that the gas-filled chamber remains inverted, with its open lower end at the vertically lowest position. This ensures that water and the like cannot enter the gas-filled chamber through the open lower end due to the pressure of the gas within the gas-filled chamber. Isolation of the second electrical contactor from the surrounding water is, thus, ensured. The vertically movable female connector unit is typically slidable over the vertically fixed male connector unit.

The second electrical component may be a renewable energy turbine, such as a tidal turbine, which is locatable on a gravity base structure incorporating the male connector unit. The female connector unit may thus form part of a renewable energy turbine. Accordingly, the wet-mateable electrical connector facilitates connection of the renewable energy turbine to a subsea electrical network. The renewable energy turbine or other second electrical component normally remains in a predetermined orientation is it moves through the water or other liquid in the vertical direction. This maintains the female connector unit in the desired orientation with the gas-filled chamber inverted.

The gas contained within the chamber of the female connector unit is intended to exclude water and the like from the chamber and the chamber is therefore pressurisable at least by virtue of lowering the female connector unit into the water, and may additionally be pressurisable by introducing pressurised gas into the chamber.

In preferred embodiments, the insulating sheath defines a cavity containing a gas to exclude water and the like therefrom. The cavity normally includes a closed upper end and an open lower end for receiving the upper end of the vertically fixed male connector unit. The gas-filled cavity formed in the insulating sheath isolates the first electrical contactor from the surrounding liquid when the upper end of the vertically fixed male connector unit is not received in the gas-filled chamber of the vertically movable female connector unit. This construction avoids the need for mechanical contact seals which are normally prone to degradation, and hence leakage, over time. It also avoids the need for close tolerances which are typically necessary with mechanical contact seals.

The gas within the chamber of the female connector unit and/or within the cavity of the insulating sheath may be air or a suitable inert gas.

The first electrical contactor may include an upwardly tapered first contact surface and the second electrical contactor may include a corresponding downwardly tapered second contact surface. This may facilitate disconnection of the male and female connector units in the event of failure of the movable first or second electrical contactors. Such disconnection could be achieved by a generally vertically upwards movement of the female connector unit. The first and second electrical contactors could, however, have any suitable geometry.

One or both of the first electrical contactors may be movable to permit engagement of the first and second electrical contactors. More typically, one of the first and second electrical contactors is fixed and the other of the first and second electrical contactors is movable. The provision of only one moving electrical contactor simplifies the construction of the wet-mateable electrical connector.

In typical embodiments, the first electrical contactor is fixed and the second electrical contactor is movable to permit engagement of the first and second electrical contactors. The female connector unit may, thus, include an actuator to effect movement of the second electrical contactor.

The first electrical contactor may include a plurality of contact poles. The female connector unit may include a plurality of said second electrical contactors. Where the first electrical contactor includes a plurality of contact poles, each of said second electrical contactors may be engageable with one of the contact poles. The plurality of contact poles may be circumferentially spaced about the vertically fixed male connector unit and/or may be vertically spaced along the vertically fixed male connector unit.

The insulating sheath may be negatively buoyant to maintain it in the first position when the female connector unit is not located over the male connector unit. The density of the insulating sheath is selected to provide the required negative buoyancy. The insulating sheath may be formed of an electrically insulating material such as a ceramic material.

The wet-mateable electrical connector may include a protective sleeve which may be movable between an active position in which it may surround the insulating sheath when the male and female connector units are disconnected and an inactive position it which it may expose the insulating sheath. The protective sleeve may be positively buoyant to displace it towards, and maintain it in, the active position. The protective sleeve protects an outer surface of the insulating sheath and prevents the accumulation of unwanted matter, principally sessile animals such as barnacles, on the outer surface. This prevents any fouling between the outer surface of the insulating sheath and the upper end of the gas-filled chamber of the female connector unit that might otherwise prevent the insulating sheath from being moved to the second position within the upper end of the female connector unit.

The male connector unit may include a restraint to limit the upward vertical movement of the protective sleeve and thereby define the active position of the protective sleeve. The restraint may be provided on the substantially vertical support member. The restraint is typically a collar.

The protective sleeve may include a lower end having an aperture through which the male connector unit, and in particular the substantially vertical support member, passes. This enables the protective sleeve to slide along the male connector unit in a vertically upwards or vertically downwards direction. The aperture is typically dimensioned so that there is sufficient clearance with the male connector unit, and especially the substantially vertical support member, to prevent snagging of the slidable protective sleeve on the male connector unit. Such clearance is advantageous due to the risk of accumulation of unwanted matter, such as sessile animals, on the substantially vertical support member.

The protective sleeve is typically movable from the active position towards the inactive position during location of the vertically movable female connector unit over the vertically fixed male connector unit. The open lower end of the gas-filled chamber of the female connector unit may include an entry portion with which the protective sleeve may be cooperable to move it from the active position towards the inactive position. A separate mechanism to move the protective sleeve from the active position to the inactive position is, therefore, not needed, thus further simplifying the construction and operation of the wet-mateable electrical connector.

The entry portion may be generally frustoconical and the protective sleeve may include an upper periphery having a generally complementary frustoconical configuration. This facilitates insertion of the upper end of the vertically fixed male connector unit into the gas-filled chamber of the female connector unit through the open lower end of the gas-filled chamber, and in particular optimises the cooperation between the protective sleeve and the entry portion to ensure effective movement of the protective sleeve from the active position to the inactive position.

The gas-filled chamber of the female connector unit may include a contact chamber portion housing the second electrical contactor and may include a sheath chamber portion which may receive the insulating sheath when it is in the second position.

The upper end of the vertically fixed male connector unit may be insertable into the contact chamber portion through the open lower end of the gas-filled chamber and the insulating sheath may be selectively movable into the sheath chamber portion to move it from the first position to the second position.

The insulating sheath may be pneumatically movable from the first position to the second position, for example by virtue of a pressure difference between the contact chamber portion and the sheath chamber portion. The female connector unit may include a valve arrangement for controlling the gas pressure in the gas-filled chamber. The valve arrangement may be selectively operable to provide independent control of the gas pressures in the contact chamber portion and the sheath chamber portion when the male and female connector units are in a partially connected condition in which an upper end of the insulating sheath projects into the sheath chamber portion.

The valve arrangement may be selectively operable to supply pressurised gas to the gas-filled chamber when the male and female connector units are disconnected. The pressurisation of the gas-filled chamber can, thus, be increased to ensure that water and the like surrounding the female connector unit does not enter the chamber to any significant extent and to reduce the level of any water that might be present inside the chamber. Such pressurisation may be necessary as the vertically movable female connector unit is lowered into the water.

The valve arrangement may be selectively operable to release pressurised gas from the sheath chamber portion when the male and female connector units are in the partially connected condition. The resulting pressure difference between the contact chamber portion and the sheath chamber portion, and more particularly the higher gas pressure inside the contact chamber portion relative to the lower gas pressure inside the sheath chamber portion, propels the insulating sheath fully into the sheath chamber portion, to the second position, thereby exposing the first electrical contactor on the upper end of the vertically fixed male connector unit.

The valve arrangement may be selectively operable to connect the contact chamber portion and the sheath chamber portion when the insulating sheath is fully located inside the sheath chamber portion, in the second position. This equalises the gas pressures inside the contact chamber portion and the sheath chamber portion and may allow the insulating sheath to move vertically downwards, under its own weight, out of the sheath chamber portion into the contact chamber portion to the first position.

The valve arrangement may be selectively operable to introduce pressurised gas into the sheath chamber portion when the insulating sheath is fully located inside the sheath chamber portion, in the second position. This increases the gas pressure inside the sheath chamber portion which is thus higher than the gas pressure inside the contact chamber portion and the resulting pressure difference may propel the insulating sheath vertically downwards out of the sheath chamber portion and into the contact chamber portion to the first position. Operation of the valve arrangement in this way can be useful if there is failure of the actuator for moving the first or second electrical contactor, since the forced movement of the insulating sheath may displace the first or second electrical contactor and thereby disengage the first and second electrical contactors.

The insulating sheath may be mechanically movable from the first position to the second position. The female connector unit may include an actuator arrangement for selectively moving the insulating sheath to the second position inside the sheath chamber portion. The actuator arrangement may comprise an engagement member which may be engageable with the insulating sheath to move it between the first and second positions. The engagement member may be a toothed belt and may include tooth formations which engage cooperating recesses in the insulating sheath. The engagement member may alternatively be a rotatable member which frictionally engages an outer surface of the insulating sheath.

Embodiments of the connection method for the wet-mateable electrical connector may comprise pneumatically moving the insulating sheath from the first position to the second position to expose the first electrical contactor. The method may comprise varying the gas pressure inside at least one of the contact chamber portion and the sheath chamber portion to propel the insulating sheath into the sheath chamber portion, to the second position. The gas pressure inside the contact chamber portion may be initially the same as the gas pressure inside the sheath chamber portion and the connection method may comprise decreasing the gas pressure inside the sheath chamber portion so that it is lower than the gas pressure inside the contact chamber portion and/or increasing the gas pressure inside the contact chamber portion so that it is higher than the gas pressure inside the sheath chamber portion. The resulting pressure difference between the sheath chamber portion and the contact chamber portion propels the insulating sheath to the second position, inside the sheath chamber portion, to expose the first electrical contactor.

The connection method may alternatively comprise mechanically moving the insulating sheath from the first position to the second position.

The connection method may comprise displacing the protective sleeve from the active position to the inactive position during location of the vertically movable female connector unit over the vertically fixed male connector unit. As explained above, the co-operation between the protective sleeve and the entry portion of the gas-filled chamber, which arises during location of the vertically movable female connector unit over the vertically fixed male connector unit, automatically displaces the protective sleeve from the active position towards the inactive position.

The connection method may include moving the second electrical contactor to engage the first and second electrical contactors.

Embodiments of the disconnection method for the wet-mateable electrical connector may comprise moving one of the first and second electrical contactors to disengage the first and second electrical contactors, prior to moving the insulating sheath from the second position to the first position. The disconnection method may comprise moving the second electrical contactor to disengage the first and second electrical contactors.

In embodiments in which the insulating sheath is pneumatically movable, the disconnection method may comprise equalising the gas pressures inside the contact chamber portion and the sheath chamber portion, thus allowing the insulating sheath to be displaced by its own weight from the second position inside the sheath chamber portion to the first position inside the contact chamber portion. In embodiments in which the first and second electrical contactors have been disengaged, the insulating sheath may be displaced by its own weight to the first position in which it covers the first electrical contactor on the upper end of the male connector unit. This would occur during normal operation of the wet-mateable electrical connector.

The disconnection method may comprise pneumatically moving the insulating sheath from the second position inside the sheath chamber portion to the first position inside the contact chamber portion. More particularly, the disconnection method may comprise increasing the gas pressure inside the sheath chamber portion so that it is higher than the gas pressure inside the contact chamber portion and/or decreasing the gas pressure inside the contact chamber portion so that it is lower than the gas pressure inside the sheath chamber portion, whereby the resulting pressure difference propels the insulating sheath out of the sheath chamber portion, from the second position, and into the contact chamber portion, to the first position. As mentioned above, this mode of disconnection may be preferred if the first or second electrical contactors cannot be disengaged by moving the first or second electrical contactor, for example as a result of failure of the actuator for moving the first or second electrical contactor.

In embodiments in which the insulating sheath is mechanically movable, the disconnection method may comprise mechanically moving the insulating sheath from the second position to the first position.

The step of separating the vertically movable female connector unit from the vertically fixed male connector unit may comprise raising the vertically movable female connector unit.

The protective sleeve may be displaced from the inactive position to the active position during said separation of the vertically movable female connector unit from the vertically fixed male connector unit. As discussed above, this movement occurs automatically in embodiments in which the protective sleeve is positively buoyant.

DETAILED DESCRIPTION OF EMBODIMENTS OF THE INVENTION

Embodiments of the present invention will now be described by way of example only and with reference to the accompanying drawings.

Figure 1:
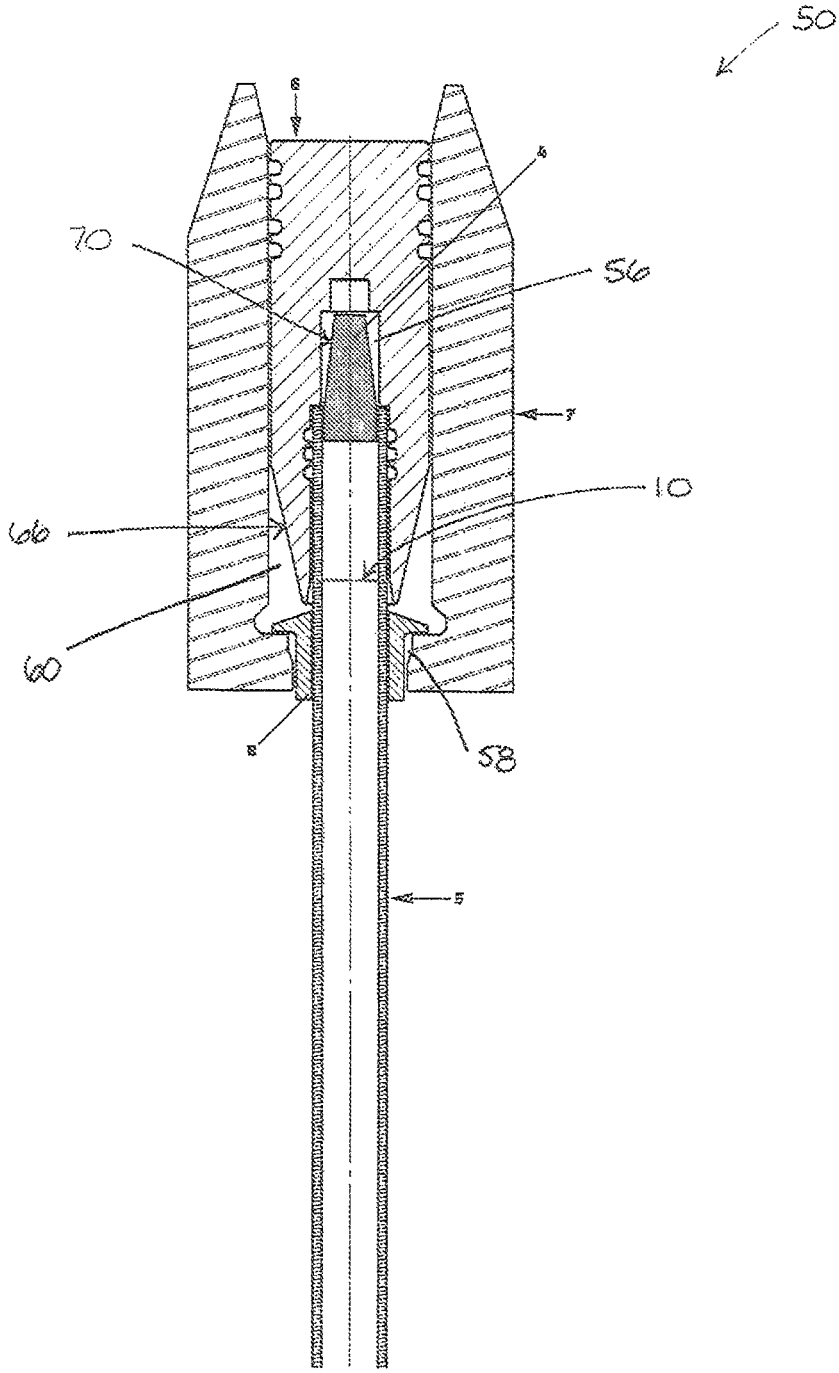
FIG. 1 is diagrammatic cross-sectional view of a male connector unit of a wet-mateable electrical connector.
Figure 2:
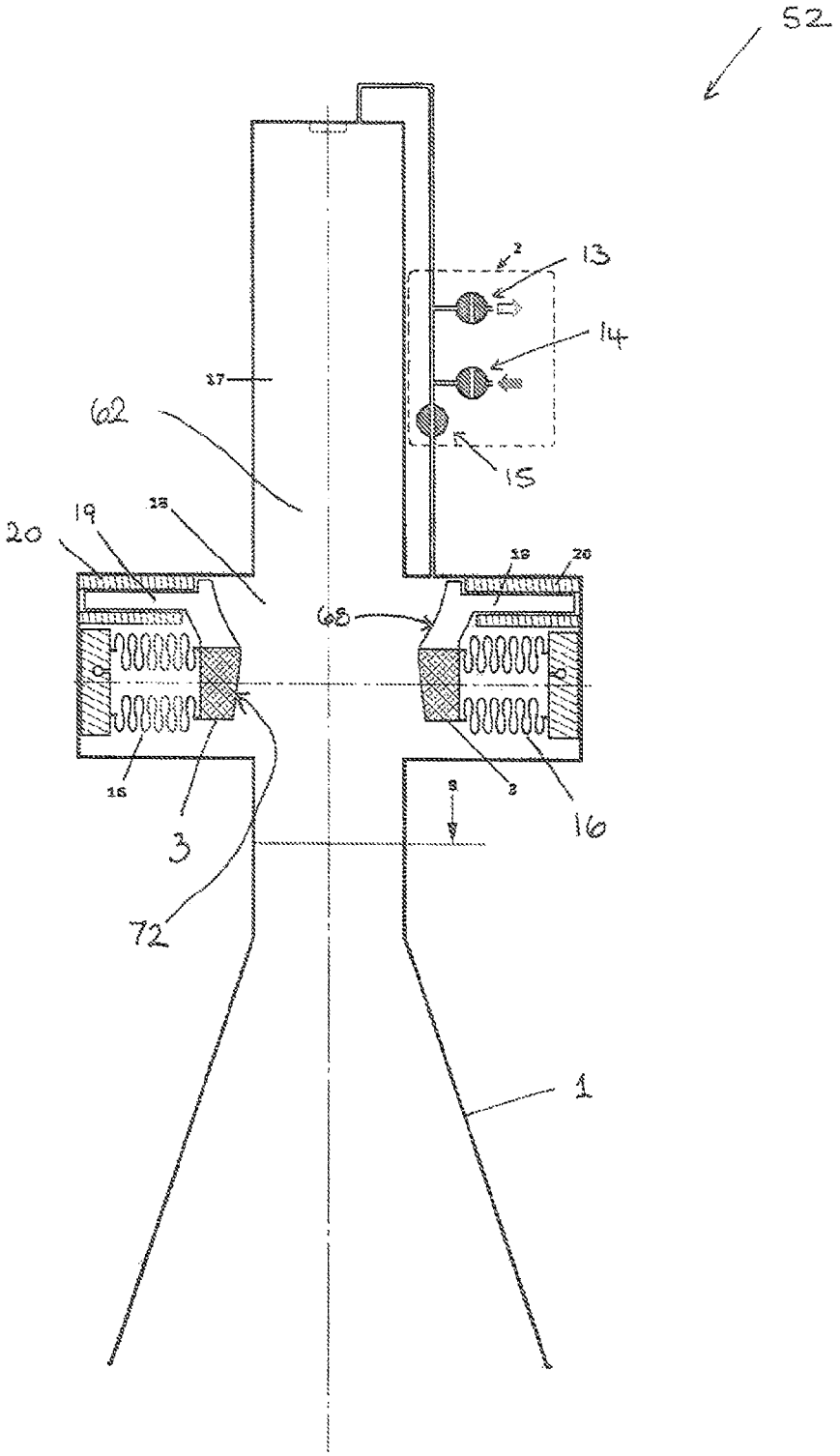
FIGS. 2 and 3 are diagrammatic cross-sectional views of a female connector unit of the wet-mateable electrical connector.

FIGS. 1 and 2 illustrate respectively a vertically fixed male connector unit 50 and a vertically movable female connector unit 52 which can be connected and disconnected in water or a similar liquid, and which together form a wet-mateable electrical connector. As discussed above, the wet-mateable electrical connector is particularly suitable for connection and disconnection underwater, in subsea environments. Although not shown in the drawings, the male and female connector units 50, 52 are immersed in, and therefore surrounded by, water. Internal waterlines are, however, illustrated where appropriate.

Referring initially to FIG. 1, the vertically fixed male connector unit 50 includes a substantially vertical rigid support member 5 which extends upwardly from a fixed gravity base structure (not shown) and is permanently connected in a fixed position to a subsea electrical network by subsea electrical cables. The male connector unit 50 includes a first electrical contactor 4 at the upper end of the vertical support member 5 which is fixed (i.e. immovable).

The electrical connector includes an insulating sheath 6 formed from a ceramic or other electrically insulating material and having a closed upper end and an open lower end which define a cavity 56. In the condition illustrated in FIG. 1 in which the male connector unit 50 is disconnected from the female connector unit 52, the insulating sheath 6 is located in a first position, on the upper end of the vertical support member 5, in which it protects the first electrical contactor 4. The inverted cavity 56 is filled with a suitable pressurised gas, such as air, and water surrounding the male connector unit 50 is, thus, substantially excluded from the interior of the gas-filled cavity 56. This is illustrated by the internal waterline 10 which indicates the water level inside the inverted gas-filled cavity 56. Accordingly, the first electrical contactor 4 is isolated from water and the like surrounding the male connector unit 50.

The insulating sheath 6 is negatively buoyant and is retained in position on the upper end of the vertical support member 5 by its own weight. A relatively dense electrically insulating material, such as a ceramic material, is thus advantageously employed.

The electrical connector includes a protective sleeve 7 which is movable between an active position shown in FIG. 1 in which it surrounds the insulating sheath 6 and an inactive position in which it exposes the insulating sheath 6. The protective sleeve 7 includes a lower end having an aperture 58 which enables it to slide along the vertical support member 5 between the active and inactive positions and defines a tubular recess 60 in which the insulating sheath 6 is accommodated when the protective sleeve 7 is in the active position. The aperture 58 is sufficiently large to prevent the protective sleeve 7 from becoming snagged on the vertical support member 5 during sliding movement, even if there is an accumulation of barnacles or other sessile animals on the vertical support member 5. The upper periphery of the protective sleeve 7 has a generally frustoconical configuration.

The protective sleeve 7 is positively buoyant and is, therefore, urged to the active position by virtue of its inherent buoyancy. The clearance between the inner surface of the buoyant protective sleeve 7 and the outer surface of the insulating sheath 6 is sufficient to allow the insulating sheath 6 to be accommodated in the tubular recess 60 but is sufficiently small to ensure that barnacles or other sessile animals cannot accumulate on the outer surface of the insulating sheath 6. A collar 8 is fixed to the vertical support member 5 and this limits the upward movement of the buoyant protective sleeve 7 and thus defines the active position of the buoyant protective sleeve 7.

Figure 3:
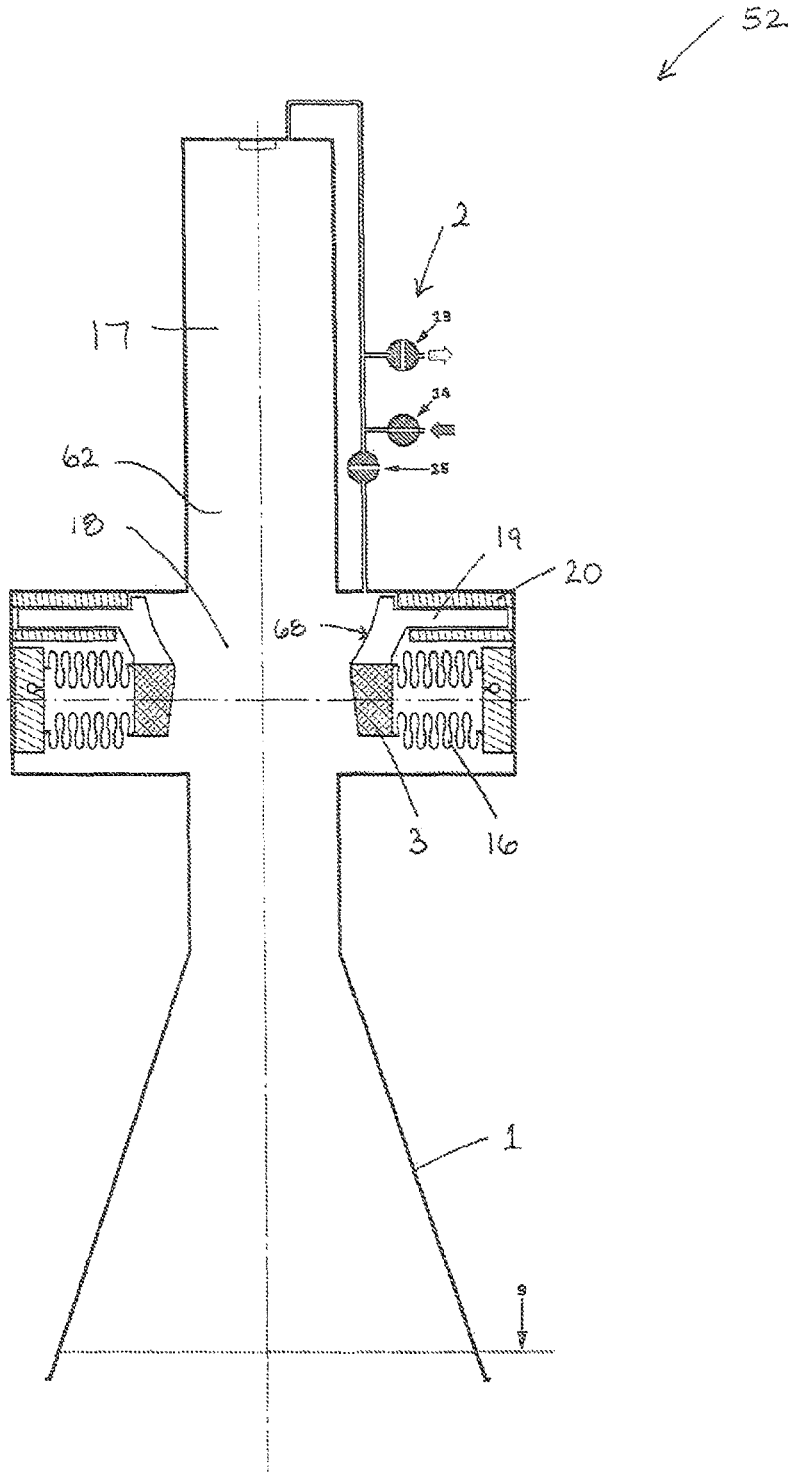

Referring now to FIGS. 2 and 3, the female connector unit 52 is generally cylindrical and includes a closed upper end and an open lower end which together define a chamber 62. The chamber 62 includes a sheath chamber portion 17 and a contact chamber portion 18. The female connector unit 52 is movable in a generally vertical direction through the water or similar liquid to enable it to be located over (during connection), and separated from (during disconnection), the vertically fixed male connector unit 50. The female connector unit 52 typically forms part of a renewable energy turbine, such as a tidal turbine, which can be lowered into the water in a generally fixed orientation and secured to the gravity base structure and which can also be detached from the gravity base structure and raised out of the water for repair or service. Such lowering and retrieval of the renewable energy turbine normally occurs when tidal currents are minimal and the turbine is inoperative so that there is no electrical current flowing through the wet-mateable electrical connector at the time of connection or disconnection. Accordingly, the wet-mateable electrical connector typically acts as a contactor device.

Figure 14:
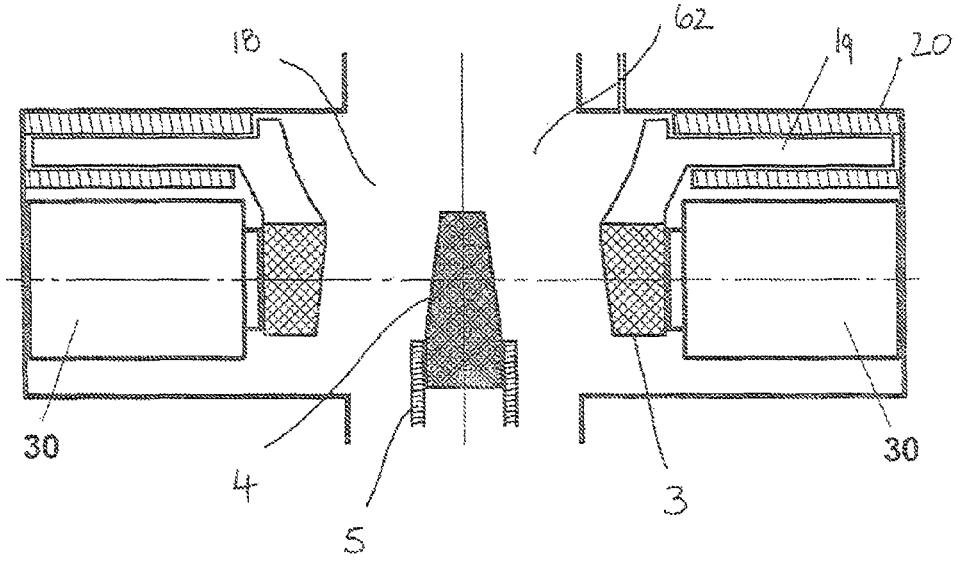
FIGS. 14*a* and 14*b* are diagrammatic cross-sectional views of part of an alternative female connector unit in which the second electrical contactor is hydraulically actuated.
Figure 14:
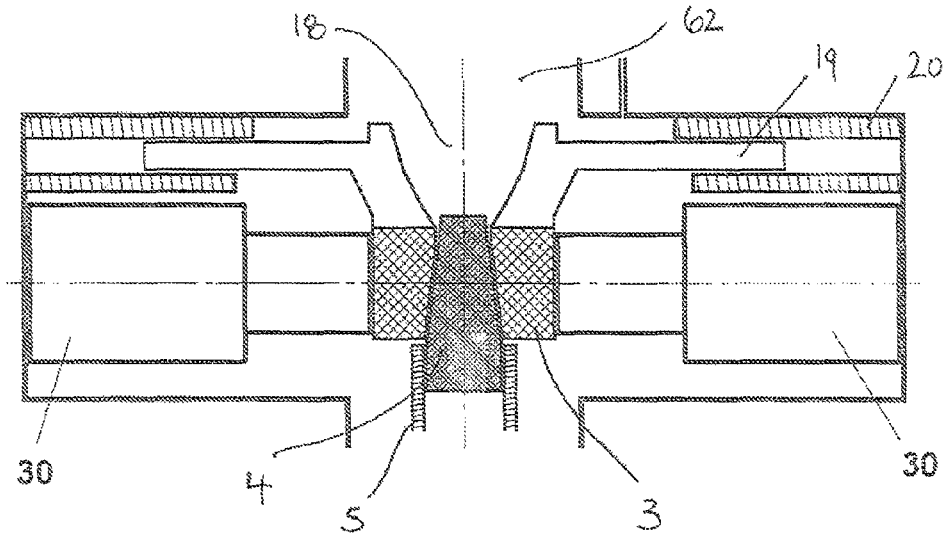

A plurality of circumferentially spaced second electrical contactors 3 is located in the contact chamber portion 18. The second electrical contactors 3 are movable between a disengaged position shown in FIGS. 2 and 3 and an engaged position shown in FIG. 8. The second electrical contactors 3 are mounted on contactor carriers 19 located in contactor guides 20 and an actuator in the form of pressurised bellows 16 provides selective movement of the second electrical contactors 3 between the engaged and disengaged positions. As shown in FIG. 14, any suitable actuators, such as hydraulic actuators 30, could be used to move the second electrical contactors 3 between the disengaged position shown in FIG. 14*a* and the engaged position shown in FIG. 14*b*.

Like the cavity 56, the chamber 62 is independently filled with a suitable pressurised gas, such as air, so that water surrounding the female connector unit 52 is substantially excluded from the gas-tilled chamber 62, and more particularly from both the sheath chamber portion 17 and the contact chamber portion 18, when the male and female connector units 50, 52 are disconnected. This is illustrated by the internal waterline 9 which indicates the water level inside the gas-filled chamber 62. Accordingly, the second electrical contactors 3 are isolated from water and the like surrounding the female connector unit 52.

The female connector unit 52 includes a valve arrangement 2 for controlling the gas pressure inside the gas-filled chamber 62. In the illustrated embodiment, the valve arrangement 2 comprises an exhaust valve 13 which can be selectively connected to a manifold or vessel at a lower pressure than the pressure inside the gas-filled chamber 62, an inlet valve 14 which can be selectively connected to a gas supply whose pressure is higher than the pressure inside the gas-filled chamber 62, and a transfer valve 15 which can be operated to selectively connect the sheath chamber portion 17 and the contact chamber portion 18. Although the exhaust valve 13, inlet valve 14 and transfer valve 15 are constituted by separate valves in the illustrated embodiment, they could form part of a multi-position valve.

The lower end of the gas-filled chamber 62 includes an entry portion 1 which is generally frustoconical and which is co-operable with the generally frustoconical upper periphery of the buoyant protective sleeve 7 of the male connector unit 50.

In order to connect the wet-mateable electrical connector, it is necessary to connect the vertically fixed male connector unit 50 and the vertically movable female connector unit 52. This is achieved by lowering the renewable energy turbine (not shown), and hence lowering the female connector unit 52, through the water towards the male connector unit 50 whilst maintaining the female connector unit 52 in the orientation shown in FIG. 2. Any suitable guide arrangement can be used to guide the renewable energy turbine into position as it is lowered through the water. As the female connector unit 52 is lowered deeper into the water, the water level inside the gas-filled chamber 62 increases due to the increased hydrostatic pressure of the surrounding water. The water level inside the female connector unit 52 may extend into the entry portion 1 as shown by the internal waterline 9 in FIG. 2.

If it becomes necessary to decrease the water level inside the gas-filled chamber 62, pressurised gas can be introduced into the chamber 62 by momentarily opening the inlet valve 14 as shown in FIG. 3 whilst maintaining the exhaust valve 13 in the closed position. The expansion of the pressurised gas to match the local hydrostatic pressure expels water from the chamber 62 through the open lower end and thus lowers the water level inside the chamber 62, for example to the position shown in FIG. 3 by the internal waterline 9.

Figure 4:
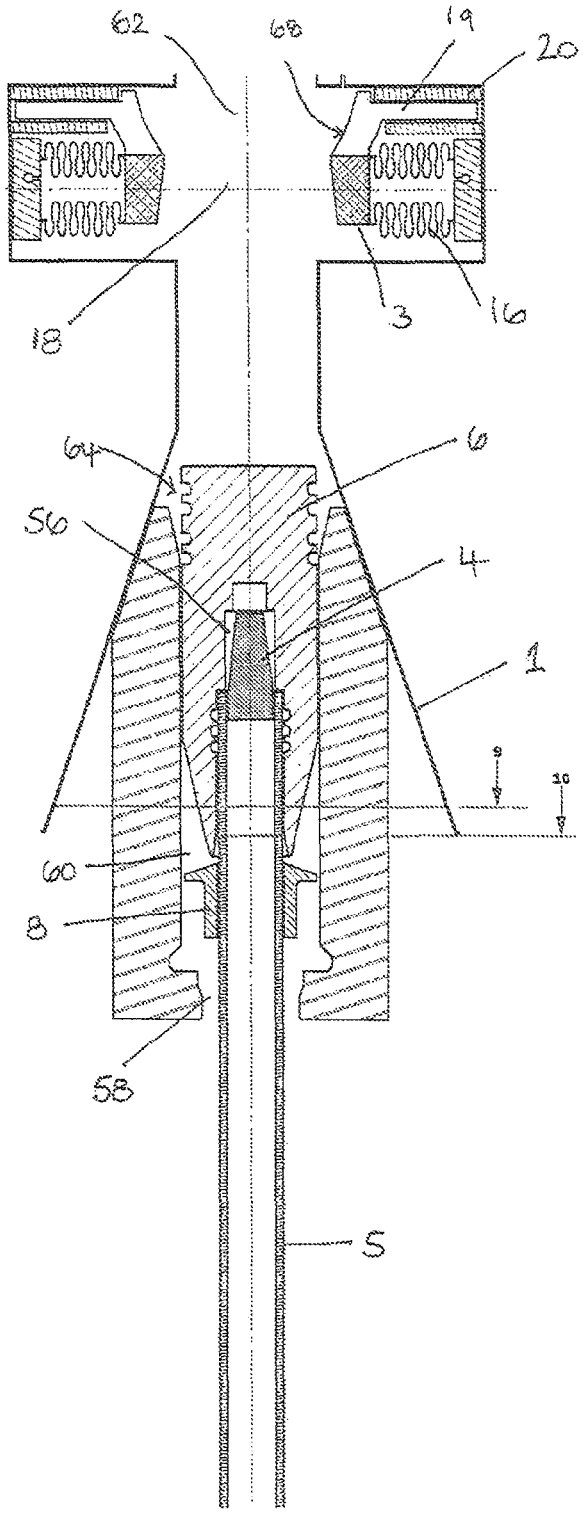
FIGS. 4 to 8 are diagrammatic cross-sectional views of the wet-mateable electrical connector showing the interaction between the male and female connector units of FIGS. 1 to 3 at various stages between the disconnected and connected conditions.
Figure 5:
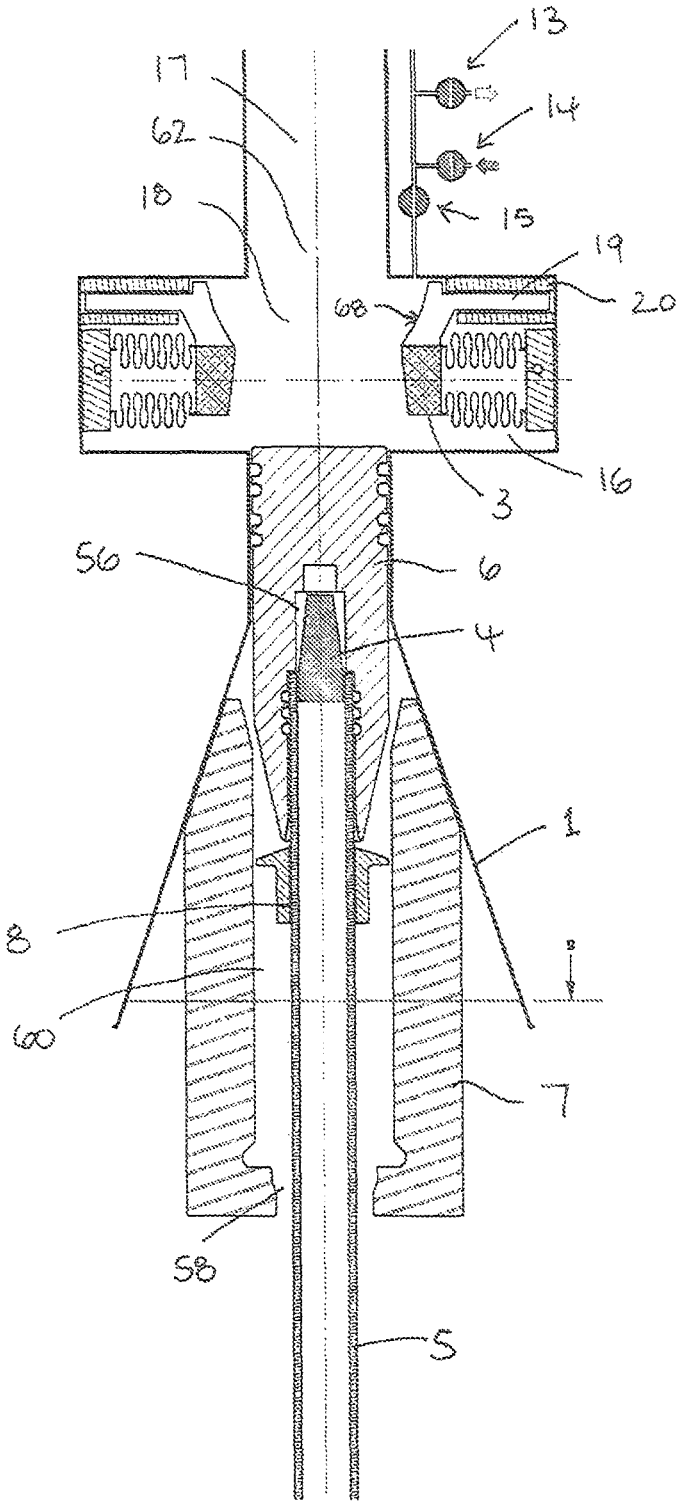

As shown in FIG. 4, as the vertically movable female connector unit 52 slides over the vertically fixed male connector unit 50, the frustoconical upper periphery of the buoyant protective sleeve 7 engages the frustoconical entry portion 1 at the lower end of the gas-filled chamber 62 and starts to slide the buoyant protective sleeve 7 down the vertical support member 5 from the active position. Continued downward movement of the renewable energy turbine, and hence of the female connector unit 52, slides the buoyant protective sleeve 7 further down the vertical support member 5 exposing the insulating sheath 6, as best seen in FIG. 5. The insulating sheath 6 and covered first electrical contactor 4 move upwardly further into the gas-filled chamber 62. Any residual water remaining in the tubular recess 60 inside the buoyant protective sleeve 7 drains away through the aperture 58. When the female connector unit 52 reaches the position shown in FIG. 6 in which the first and second electrical contactors 4, 3 are aligned, lowering of the female connector unit 52 ceases. In this partially connected condition, an upper end of the insulating sheath 6, which is still in the first position covering the first electrical contactor 4, projects into the sheath chamber portion 17. A seal is created between the circumferential surface at the upper end of the insulating sheath 6 and the circumferential wall at the lower end of the sheath chamber portion 17, and sealing means 64 can be provided on the insulating sheath 6 to enhance the seal. It will be appreciated that this seal isolates the sheath chamber portion 17 and the contact chamber portion 18.

Figure 6:
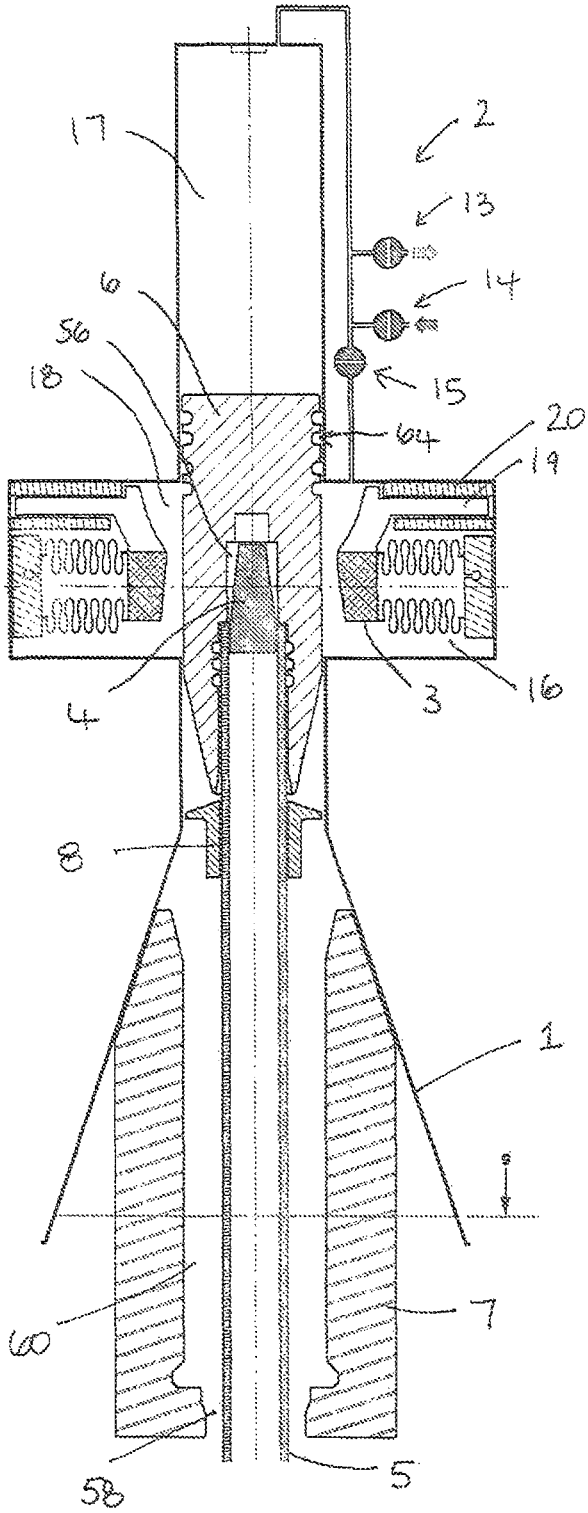
Figure 7:
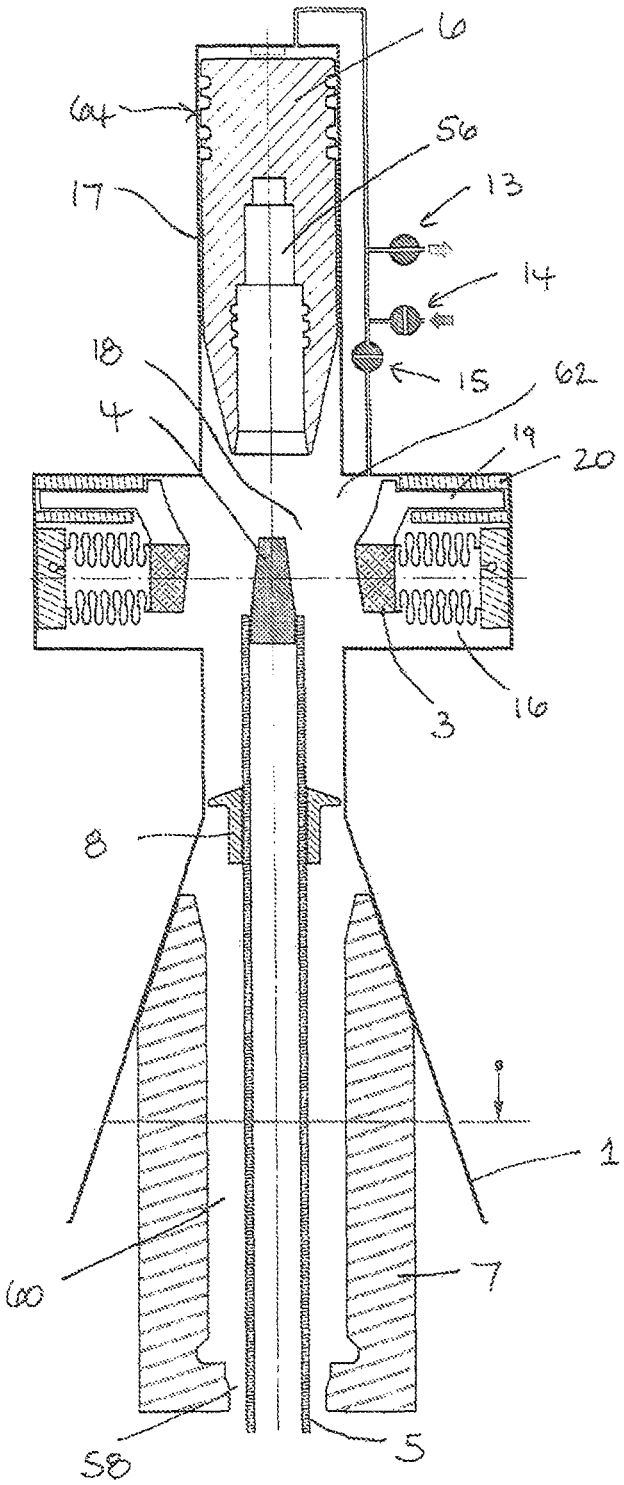

In the partially connected condition illustrated in FIG. 6, the insulating sheath 6 is isolated from the water surrounding the male and female connector units 50, 52 by the pressurised gas inside the gas-filled chamber 62 of the female connector unit 52. The insulating sheath 6 can, thus, be removed from the upper end of the vertical support member 5, and more particularly can be moved to a second position to expose the first electrical contactor 4. This can be achieved by lowering the gas pressure inside the sheath chamber portion 17 so that it is lower than the gas pressure inside the contact chamber portion 18, the resulting pressure difference propelling the insulating sheath 6 in a vertically upwards direction out of the contact chamber portion 18 and into the sheath chamber portion 17, to the second position. Referring to FIG. 7, the pressure in the sheath chamber 17 portion is reduced by opening the exhaust valve 13 whilst maintaining both the inlet valve 14 and the transfer valve 15 in their closed position.

Figure 8:
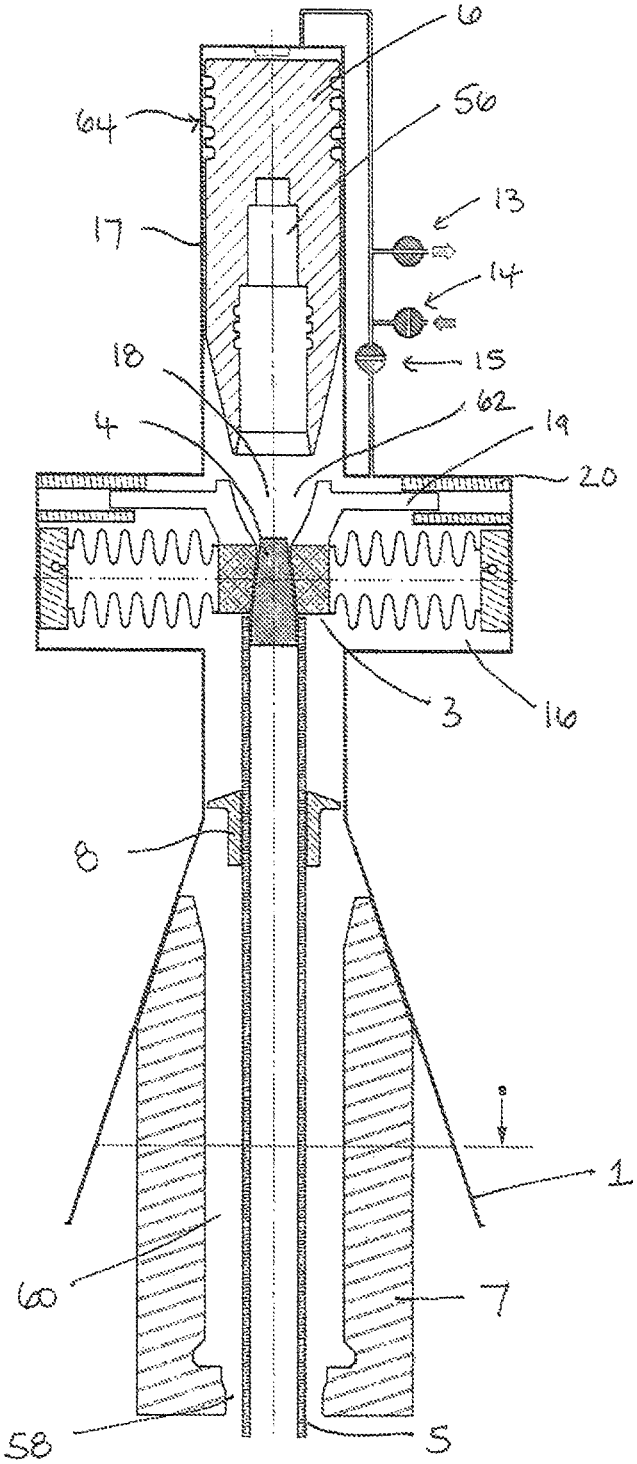

Connection of the male and female connector units 50, 52 is then completed as shown in FIG. 8 by operating the pressurised bellows 16 to move the second electrical contactors 3 to a position in which they engage, and are electrically connected to, the first electrical contactor 4. As a final step, it may be appropriate to close the exhaust valve 13, thus achieving the fully connected condition shown in FIG. 9.

In order to disconnect the male and female connector units 50, 52 during normal operation of the wet-mateable electrical connector, the steps described above are carried out in reverse order. However, after moving the second electrical contactors 3 to disengage them from the first electrical contactor 4, the insulating sheath 6 is normally displaced from the second position inside the sheath chamber portion 17 to the first position inside the contact chamber portion 18 to cover the first electrical contactor 4 by simply opening the transfer valve 15. This connects the sheath chamber portion 17 and the contact chamber portion 18 and equalises the gas pressures within the sheath chamber portion 17 and the contact chamber portion 18. The mass of the insulating sheath 6 then causes it to move downwardly from the second position to the first position inside the contact chamber portion 18 under the action of gravity. The rate of downward movement of the insulating sheath 6 is controlled by the particular flow characteristics of the transfer valve 15.

As the female connector unit 52 is moved vertically upwards through the water, the insulating sheath 6 moves downwardly until it is eventually accommodated in the recess 60 inside the buoyant protective sleeve 7. The gas that is present inside the gas-filled cavity 56 of the insulating sheath 6 once again isolates the first electrical contactor 4 from the surrounding water as the male connector unit 50 is withdrawn from the gas-filled chamber 62 of the female connector unit 52. At the same time, the buoyant protective sleeve 7 slides up the vertical support member 5 until it engages the collar 8 and is in the active position.

Figure 10:
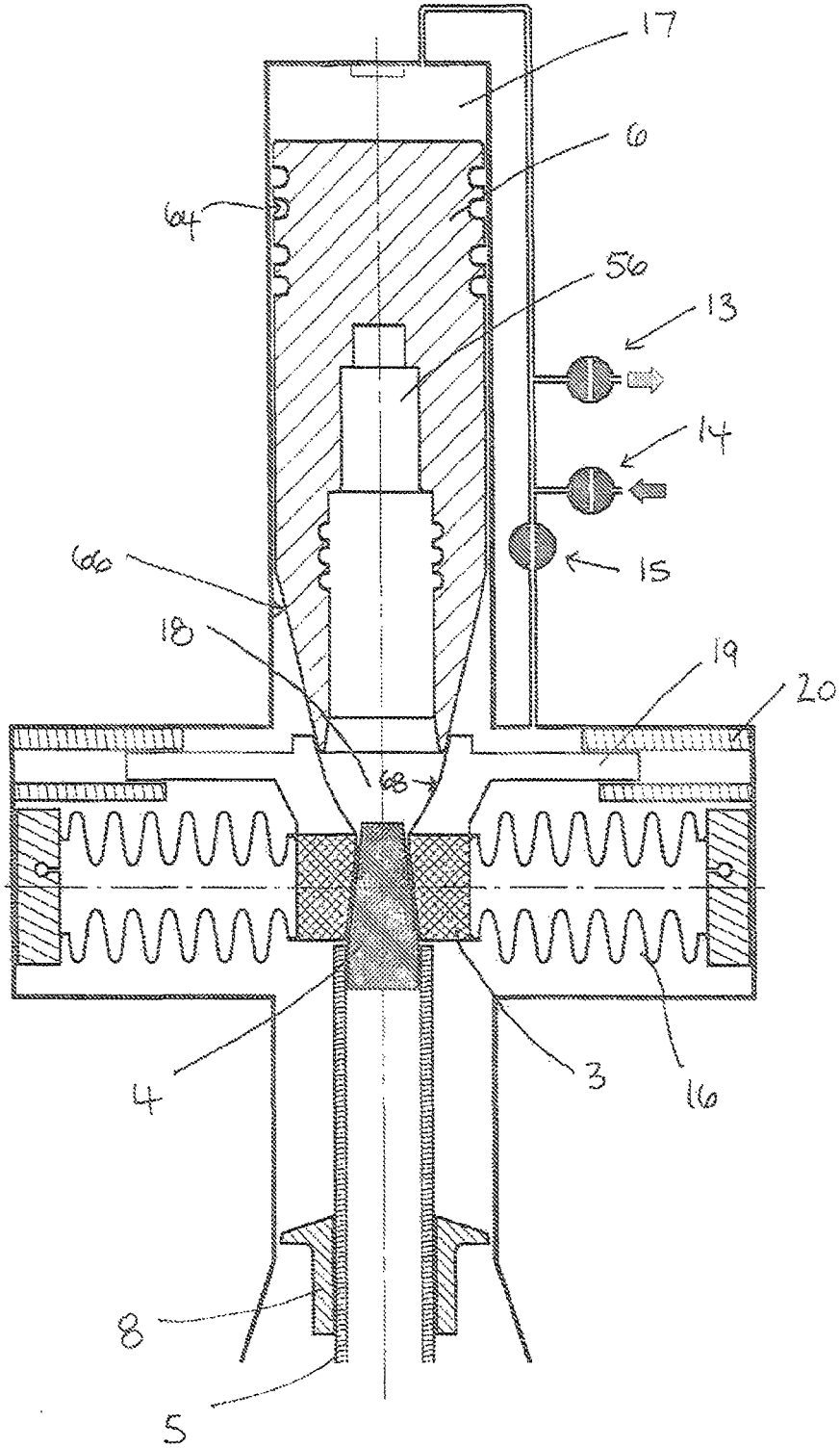
FIGS. 10 to 12 are diagrammatic cross-sectional views of the wet-mateable electrical connector of FIGS. 1 to 9 at various stages between the connected and disconnected conditions during forced disengagement of the first and second electrical contactors.
Figure 11:
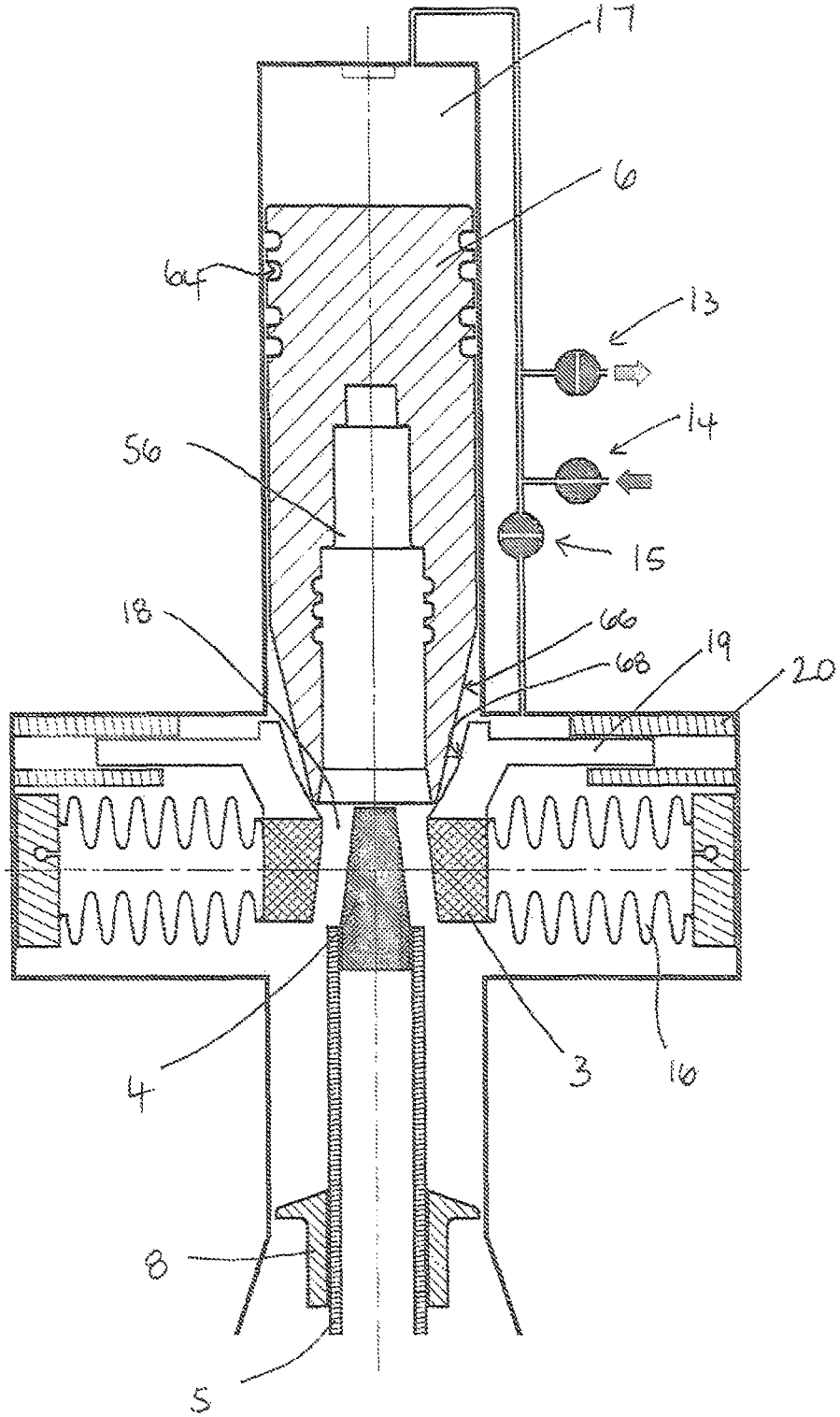
Figure 12:
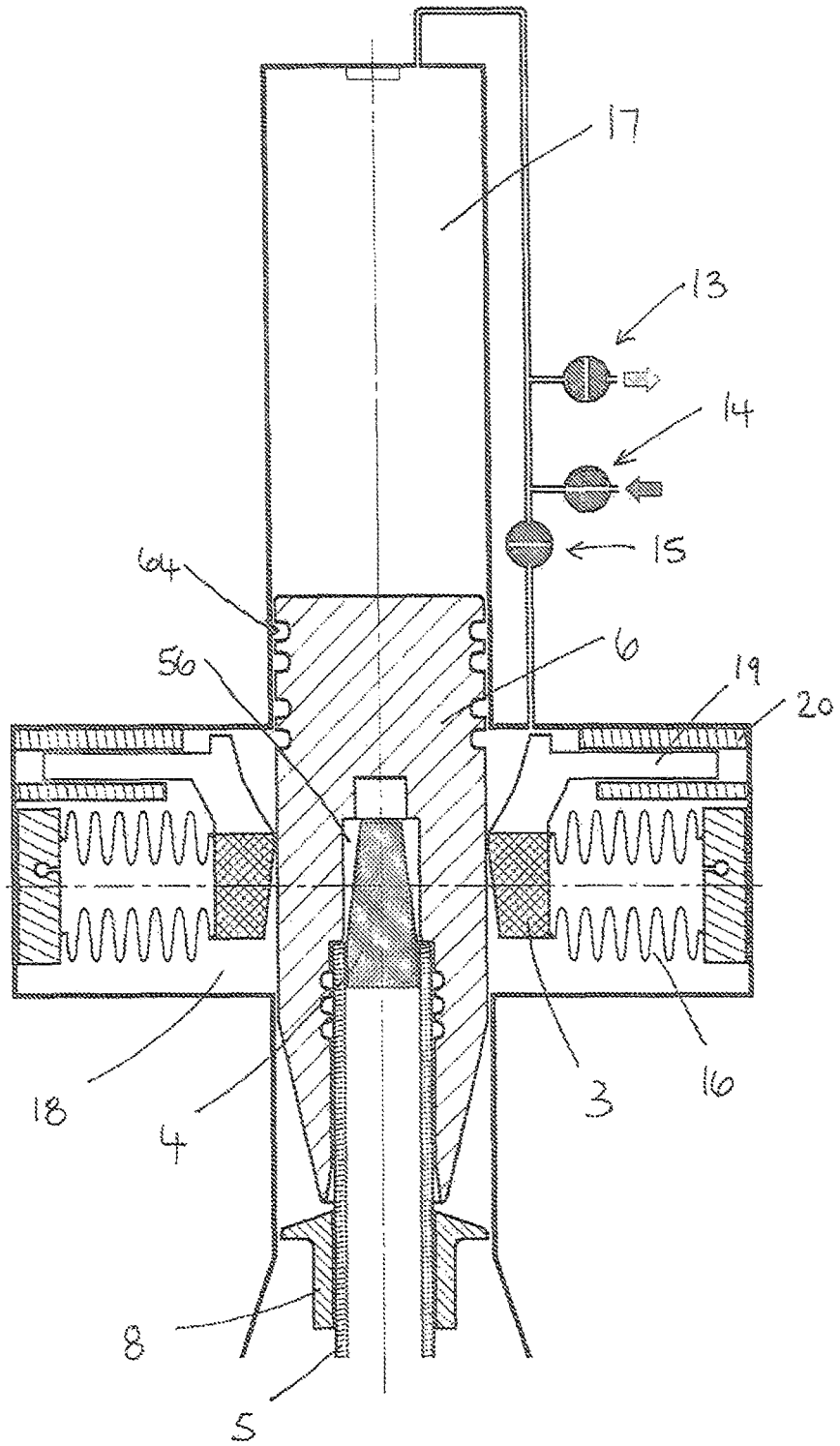

There may be circumstances in which the pressurised bellows 16 or other actuator (for example hydraulic actuator 30) fails, preventing normal movement of the second electrical contactors 3 to disengage them from the first electrical contactor 4. In these circumstances, the gas pressure inside the sheath chamber portion 17 can be increased to propel the insulating sheath 6 into the contact chamber portion 18, from the second position to the first position. More particularly, and referring to FIG. 10, the transfer valve 15 can be initially opened to allow the insulating sheath 6 to move downwardly under the action of gravity. Continued downward movement of the insulating sheath 6 is eventually prevented when the lower end of the insulating sheath 6 engages the second electrical contactors 3, and more particularly the contactor carriers 19. In the illustrated embodiment, the insulating sheath 6 and contactor carriers 19 include mutually complementary camming surfaces 66, 68. Closure of the transfer valve 15 and opening of the inlet valve 14 as shown in FIG. 11 introduces pressurised gas into the sheath chamber portion 17 and increases the gas pressure in the sheath chamber portion 17 so that it is higher than the gas pressure inside the contact chamber portion 18. This pressure difference propels the insulating sheath 6 downwardly into the contact chamber portion 18 and the cooperation between the camming surfaces 66, 68 forces the second electrical contactors 3 to move from the engaged position and separates them from the first electrical contactor 4. The downward movement of the insulating sheath 6 continues until it is located on the upper end of the vertical support member 5, in the first position, and covers the first electrical contactor 4, as shown in FIG. 12. At this point, the inlet valve 14 can be closed. Disconnection of the male and female connector units 50, 52 can then be completed as described above.

Figure 9:
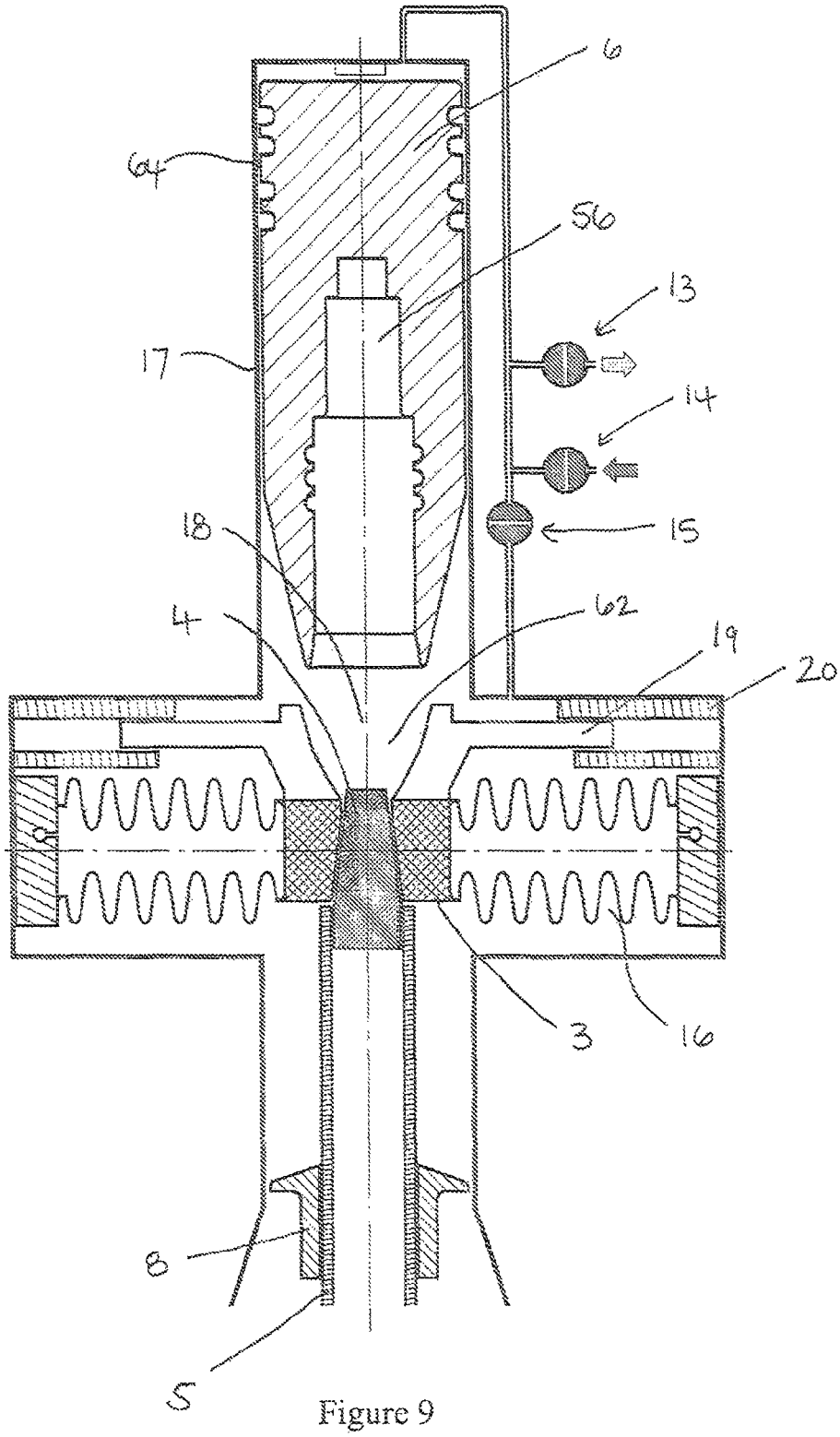
FIG. 9 is an enlarged diagrammatic cross-sectional view of part of the wet-mateable electrical connector in the connected and fully operational condition.

In the event of failure of both the pressurised bellows 16 or other actuator (for example hydraulic actuator 30) and the valve arrangement 2 so that the disconnection procedures outlined above cannot be employed, the male and female connector units 50, 52 can be disconnected by simply raising the female connector unit 52 vertically upwards through the water to withdraw the male connector unit 50 from the gas-filled chamber 62. As best seen in FIGS. 1, 2 and 9, the first and second electrical contactors 4, 3 include tapered first and second contact surfaces 70, 72 which permit separation of the first and second electrical contactors 4, 3 by moving the female connector unit 52 upwardly through the water. If the male and female connector units 50, 52 are disconnected in this way, the insulating sheath 6 normally remains inside the sheath chamber portion 17. Accordingly, the first electrical contactor 4 is placed in physical and electrical contact with the water as the male connector unit 50 is withdrawn from the gas-filled chamber 62 of the female connector unit 52. An insulating sheath 6 would, therefore, need to be located on the upper end of the vertical support member 5 in the first position and pressurised gas introduced into the cavity 56 thereof to exclude water from the cavity 56 and thereby isolate the first electrical contactor 4 from water and the like surrounding the male connector unit 50. The male connector unit 50 could then be inserted into a further female connector unit 52 in the manner described above.

Figure 15:
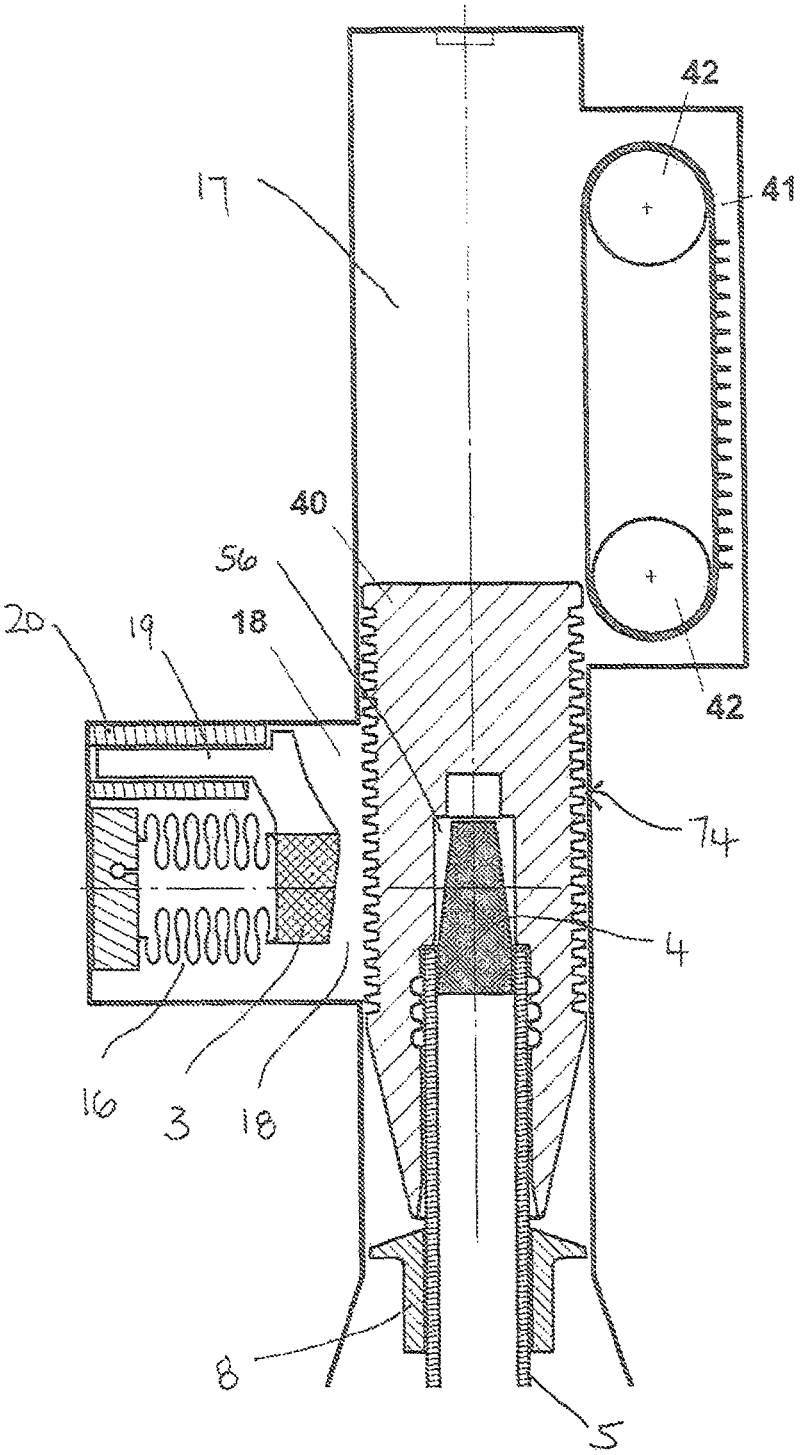
FIG. 15 is a diagrammatic cross-sectional view of an alternative wet-mateable electrical connector in which the insulating sheath is mechanically movable.
Figure 16:
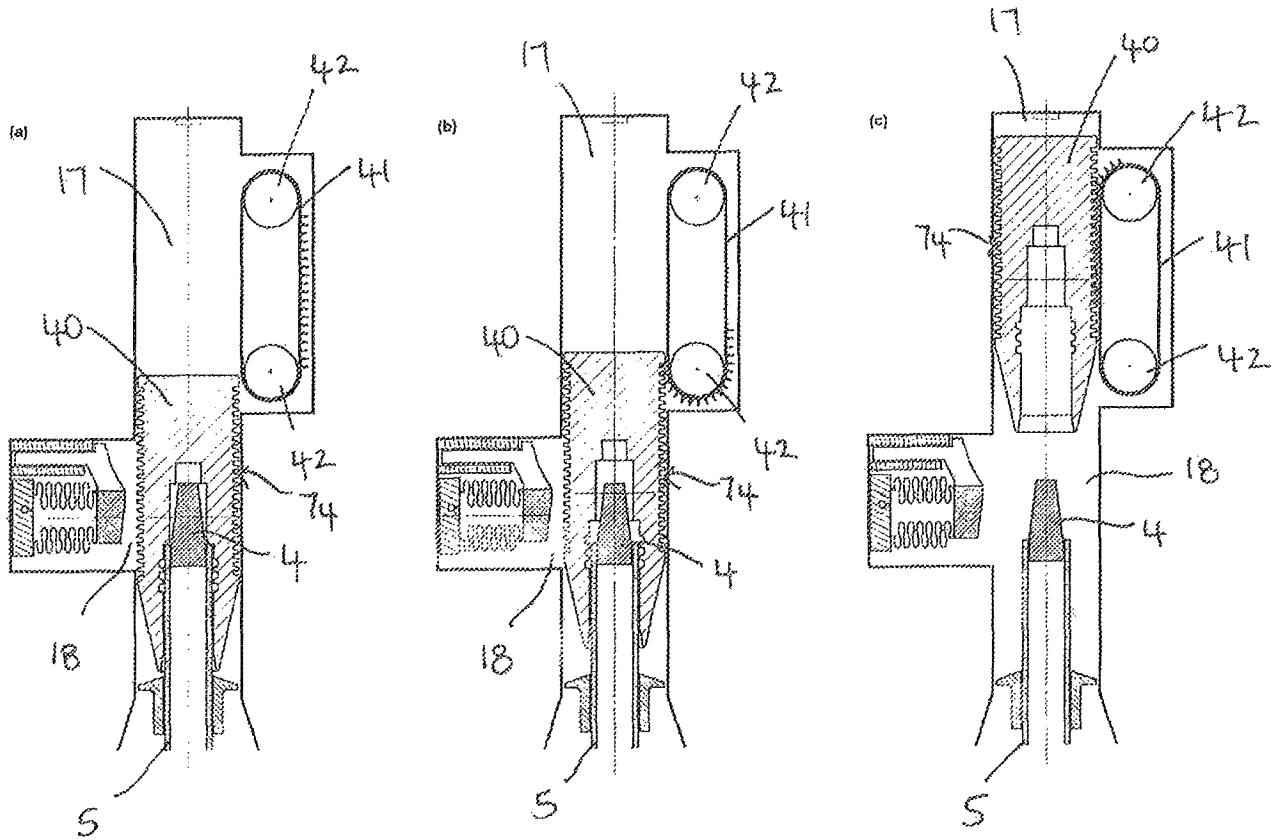
FIGS. 16*a*-16*c* are diagrammatic cross-sectional views of the alternative wet-mateable electrical connector of FIG. 15 illustrating the movement of the insulating sheath.

In an alternative embodiment of the wet-mateable electrical connector shown in FIGS. 15 and 16, a mechanical actuator arrangement is used to move an alternative insulating sheath 40 between the first position inside the contact chamber portion 18 and the second position inside the sheath chamber portion 17 to expose and cover the first electrical contactor 4 at the upper end of the vertical support member 5. The actuator arrangement comprises a partially-toothed endless belt 41 which is mounted on, and driven by, pulleys 42. The pulleys 42 can be operated by a suitable electric, pneumatic, hydraulic or other motor or actuator. The insulating sheath 40 includes a recess formation 74 comprising a plurality of recesses with which the teeth on the toothed belt 41 can cooperate.

In order to move the insulating sheath 40 into the sheath chamber portion 18 from the first position shown in FIGS. 15 and 16*a* in which it is positioned on the upper end of the vertical support member 5 inside the contact chamber portion 18, the pulleys 42 are operated to rotate the toothed belt 41 in a clockwise direction so that the teeth on the toothed belt 41 cooperate with the recess formation 74 and move the insulating sheath 6 upwardly to the second position inside the sheath chamber portion 17 as shown in FIGS. 16*b* and 16*c*. The insulating sheath 6 can subsequently be lowered from the second position inside the sheath chamber portion 17 to the first position inside the contact chamber portion 18 by operating the pulleys 42 to rotate the toothed belt 41 in an anti-clockwise direction.

Figure 13:
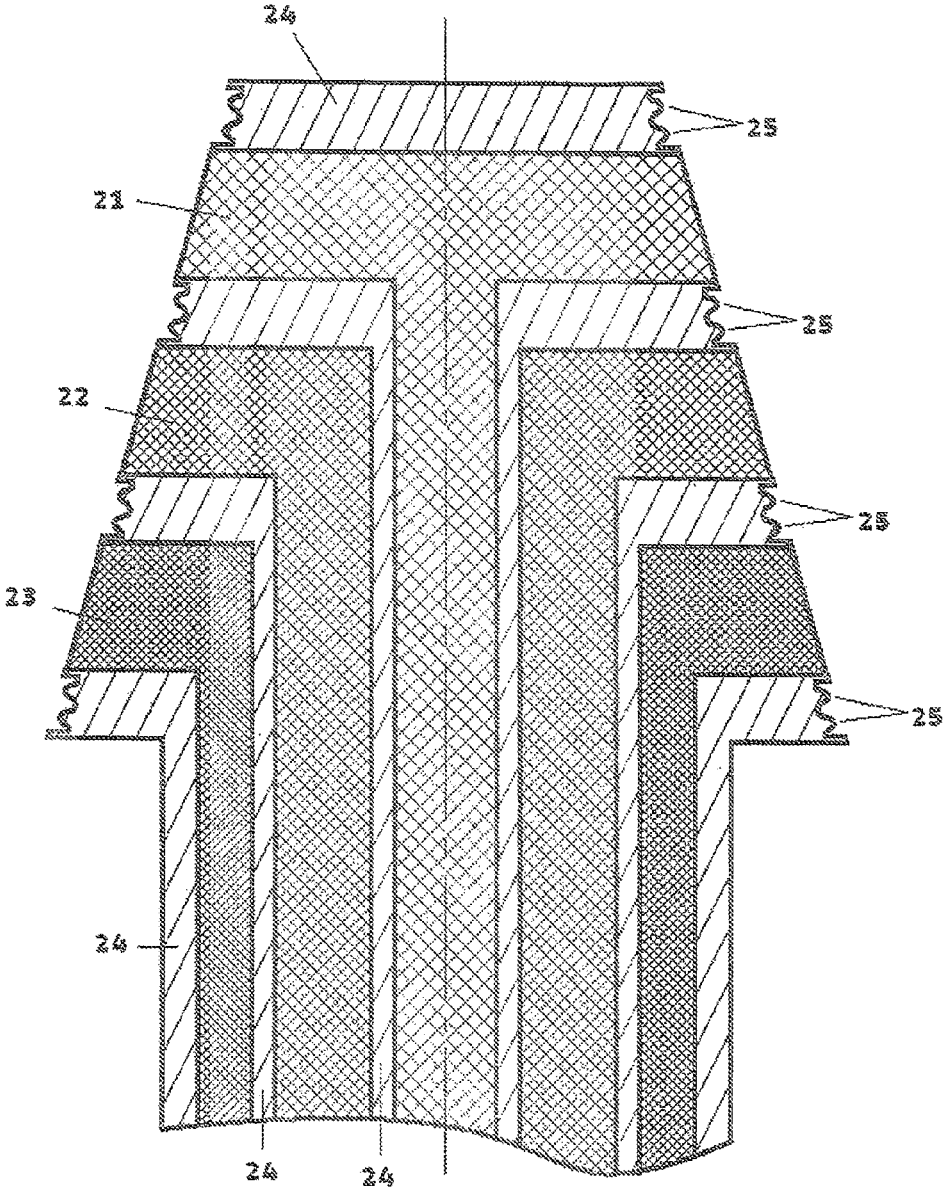
FIG. 13 is a diagrammatic cross-sectional view of a first electrical contactor having multiple contact poles.

In the embodiments described above, the first electrical contactor 4 includes a single contact pole. An alternative first electrical contactor is illustrated in FIG. 13 and comprises a plurality of contact poles 21, 22, 23 which are disposed linearly on the upper end of the vertical support member 5. The contact poles 21, 22, 23 are electrically isolated from earth and from each other by suitable insulating material 24, which optionally includes anti-creepage formations 25. Although not illustrated, it will be appreciated that a corresponding plurality of contact poles would need to be provided on the second electrical contactor 3 or indeed that a plurality of linearly spaced second electrical contactors 3 could be provided. In an alternative arrangement (not shown), a plurality of contact poles could be spaced circumferentially about the upper end of the vertical support member 5, each contact pole cooperating with a respective second electrical contactor 3.

Although embodiments of the present invention have been described in the preceding paragraphs, it should be understood that various modifications may be made to those embodiments without departing from the scope of the present invention.

The invention claimed is:

1. A wet-mateable electrical connector comprising:— a vertically movable female connector unit locatable over a vertically fixed male connector unit;

the female connector unit defining a chamber containing a gas to exclude water and the like therefrom and having a closed upper end and an open lower end for receiving an upper end of the male connector unit;

an insulating sheath locatable within the upper end of the female connector unit for movement from a first position that protects a first electrical contactor provided on the upper end of the male connector unit to a second position that exposes the first electrical contactor;

the upper end of the female connector unit housing a second electrical contactor engageable with the first electrical contactor upon movement of the insulating sheath from the first position to the second position.

2. An electrical connector according to claim 1, wherein the gas contained within the chamber of the female connector unit is pressurisable to exclude water and the like from the chamber.

3. An electrical connector according to claim 1, wherein the vertically movable female connector unit is slidable over the vertically fixed male connector unit.

4. An electrical connector according to claim 1, wherein the male connector unit is substantially rigid and is secured in use directly or indirectly to a sea bed or river bed, extending substantially vertically upwardly from the sea bed or river bed.

5. An electrical connector according to claim 1, wherein the insulating sheath defines a cavity containing a gas to exclude water and the like therefrom.

6. An electrical connector according to claim 1, wherein the insulating sheath includes a closed upper end and an open lower end for receiving the upper end of the male connector unit when in the first position.

7. An electrical connector according to claim 1, wherein the insulating sheath is negatively buoyant to maintain it in the first position when the female connector unit is not located over the male connector unit.

8. An electrical connector according to claim 1, further including a protective sleeve movable between an active position in which it surrounds the insulating sheath and an inactive position it which it exposes the insulating sheath.

9. An electrical connector according to claim 8, wherein the protective sleeve is positively buoyant to displace it towards, and maintain it in, the active position.

10. An electrical connector according to claim 9, wherein the male connector unit includes a restraint to limit the upward vertical movement of the protective sleeve and thereby define the active position.

11. An electrical connector according to claim 8, wherein the protective sleeve is movable from the active position towards the inactive position during location of the vertically movable female connector unit over the vertically fixed male connector unit.

12. An electrical connector according to claim 11, wherein the open lower end of the gas-filled chamber includes an entry portion with which the protective sleeve is cooperable to move it from the active position towards the inactive position.

13. An electrical connector according to claim 12, wherein the entry portion is generally frustoconical and the protective sleeve includes an upper periphery having a generally complementary frustoconical configuration.

14. An electrical connector according claim 1, wherein the gas-filled chamber includes a contact chamber portion housing the second electrical contactor and a sheath chamber portion in which the insulating sheath is locatable when in the second position.

15. An electrical connector according to claim 14, wherein the upper end of the male connector unit is insertable into the contact chamber portion through the open lower end of the gas-filled chamber and the insulating sheath is selectively movable into the sheath chamber portion to move it from the first position to the second position.

16. An electrical connector according claim 1, wherein the insulating sheath is pneumatically movable from the first position to the second position.

17. An electrical connector according to claim 16, wherein the female connector unit includes a valve arrangement for controlling the gas pressure in the gas-filled chamber.

18. An electrical connector according to claim 17, wherein the valve arrangement is selectively operable to supply pressurised gas to the gas-filled chamber to pressurise the chamber.

19. An electrical connector according to claim 18, wherein the gas-filled chamber includes a contact chamber portion housing the second electrical contactor and a sheath chamber portion in which the insulating sheath is locatable when in the second position and wherein the valve arrangement is selectively operable to provide independent control of the gas pressures in the contact chamber portion and the sheath chamber portion when the male and female connector units are in a partially connected condition in which an upper end of the insulating sheath projects into the sheath chamber portion.

20. An electrical connector according to claim 19, wherein the valve arrangement is selectively operable to release pressurised gas from the sheath chamber portion when the male and female connector units are in the partially connected condition to thereby displace the insulating sheath fully into the second position, inside the sheath chamber portion.

21. An electrical connector according to claim 17, wherein the valve arrangement is selectively operable to connect the contact chamber portion and the sheath chamber portion when the insulating sheath is fully located inside the sheath chamber portion, in the second position.

22. An electrical connector according to claim 17, wherein the valve arrangement is selectively operable to introduce pressurised gas into the sheath chamber portion when the insulating sheath is located inside the sheath chamber portion, in the second position.

23. An electrical connector according to claim 1, wherein the insulating sheath is mechanically movable from the first position to the second position.

24. An electrical connector according to claim 23, wherein the female connector unit includes an actuator arrangement for selectively moving the insulating sheath between the first and second positions, the actuator arrangement including an engagement member which is engageable with the insulating sheath.

25. An electrical connector according to claim 1, wherein the first electrical contactor includes an upwardly tapered first contact surface and the second electrical contactor includes a corresponding downwardly tapered second contact surface.

26. An electrical connector according to claim 1, wherein the first electrical contactor is fixed and the second electrical contactor is movable to permit said engagement of the first and second electrical contactors.

27. A connection method for a wet-mateable electrical connector according to claim 1, the connection method comprising:

locating the vertically movable female connector unit over the vertically fixed male connector unit to locate the upper end of the male connector unit inside the gas-filled chamber of the female connector unit;

locating the insulating sheath within the upper end of the female connector unit for movement from the first position to the second position to thereby expose the first electrical contactor; and engaging the first and second electrical contactors.

28. A connection method according to claim 27, wherein the connection method comprises pneumatically moving the insulating sheath from the first position to the second position to expose the first electrical contactor.

29. A connection method according to claim 28, wherein the gas-filled chamber includes a contact chamber portion housing the second electrical contactor and a sheath chamber portion in which the insulating sheath is locatable when in the second position and wherein the method comprises varying the gas pressure inside at least one of the contact chamber portion and the sheath chamber portion to propel the insulating sheath into the sheath chamber portion, to the second position.

30. A connection method according to claim 29, wherein the gas pressure inside the contact chamber portion is initially the same as the gas pressure inside the sheath chamber portion and the connection method comprises decreasing the gas pressure inside the sheath chamber portion so that it is lower than the gas pressure inside the contact chamber portion, said pressure difference propelling the insulating sheath into the sheath chamber portion, to the second position.

31. A connection method according to claim 27, wherein the connection method comprises mechanically moving the insulating sheath from the first position to the second position to expose the first electrical contactor.

32. A connection method according to claim 27, wherein the protective sleeve is movable from the active position towards the inactive position during location of the vertically movable female connector unit over the vertically fixed male connector unit and wherein the connection method comprises displacing the protective sleeve from the active position to the inactive position during location of the vertically movable female connector unit over the vertically fixed male connector unit.

33. A connection method according to claim 27, wherein the connection method includes moving the second electrical contactor to engage the first and second electrical contactors.

34. A disconnection method for a wet-mateable electrical connector according to claim 1 in which the male and female connector units have been connected in accordance with a method comprising:

locating the vertically movable female connector unit over the vertically fixed male connector unit to locate the upper end of the male connector unit inside the gas-filled chamber of the female connector unit;

locating the insulating sheath within the upper end of the female connector unit for movement from the first position to the second position to thereby expose the first electrical contactor; and engaging the first and second electrical contactors, the disconnection method comprising:

moving the insulating sheath from the second position to the first position; and separating the vertically movable female connector unit from the vertically fixed male connector unit to remove the upper end of the male connector unit from the gas-filled chamber of the female connector unit.

35. A disconnection method according to claim 34, wherein the disconnection method comprises disengaging the first and second electrical contactors, prior to moving the insulating sheath from the second position to the first position.

36. A disconnection method according to claim 35, wherein the disconnection method comprises moving the second electrical contactor to disengage the first and second electrical contactors.

37. A disconnection method according to claim 34, wherein the gas-filled chamber includes a contact chamber portion housing the second electrical contactor and a sheath chamber portion in which the insulating sheath is locatable when in the second position and the disconnection method comprises equalising the gas pressures inside the contact chamber portion and the sheath chamber portion to allow the insulating sheath to be displaced by its own weight from the second position inside the sheath chamber portion to the first position inside the contact chamber portion.

38. A disconnection method according to claim 34, wherein the disconnection method comprises pneumatically moving the insulating sheath from the second position to the first position.

39. A disconnection method according to claim 38, wherein the disconnection method comprises increasing the gas pressure inside the sheath chamber portion so that it is higher than the gas pressure inside the contact chamber portion to propel the insulating sheath from the second position to the first position.

40. A disconnection method according to claim 34, wherein the disconnection method comprises mechanically moving the insulating sheath from the second position to the first position.

41. A disconnection method according to claim 34, wherein the protective sleeve is movable from the active position towards the inactive position during location of the vertically movable female connector unit over the vertically fixed male connector unit and the protective sleeve is displaced from the inactive position to the active position during said separation of the vertically movable female connector unit and the vertically fixed male connector unit.

* * * * *